United States Patent [19]

Neugebauer

[11] Patent Number: 4,924,750

[45] Date of Patent: May 15, 1990

[54] ELECTROMAGNETIC LAUNCHER WITH IMPROVED CURRENT COMMUTATING SWITCH PERFORMANCE

[75] Inventor: Wendell Neugebauer, Ballston Spa, N.Y.

[73] Assignee: General Electric Company, Pittsfield, Mass.

[21] Appl. No.: 288,938

[22] Filed: Dec. 23, 1988

[51] Int. Cl.[5] ..... F41F 1/02

[52] U.S. Cl. ..... 89/8; 124/3

[58] Field of Search ..... 89/8; 124/3

[56] References Cited

U.S. PATENT DOCUMENTS

| | | | |
|---|---|---|---|
| H357 | 11/1987 | Howland et al. | 89/8 |
| 4,347,463 | 8/1982 | Kemeny et al. | 318/135 |
| 4,355,561 | 10/1982 | Kemeny et al. | 89/8 |
| 4,369,691 | 1/1983 | Baehr, Jr. et al. | 89/8 |
| 4,369,692 | 1/1983 | Kemeny | 89/8 |
| 4,433,608 | 2/1984 | Deis et al. | 89/8 |
| 4,555,972 | 12/1985 | Heyne | 89/8 |
| 4,754,687 | 7/1988 | Kemeny | 89/8 |

*Primary Examiner*—Stephen C. Bentley

*Attorney, Agent, or Firm*—Bailin L. Kuch; Robert A. Cahill

[57] ABSTRACT

To improve the performance and life of a charging current-conducting commutating switch in an inductor storage-type electromagnetic launcher, the energy expended in propelling a mass through a breech rail gun section at a high velocity is utilized to generate a current in the breech section rails which flows through the commutating switch in opposition to the inductor charging current. The switch is opened in coordination with the movement of the mass through the launcher with little or no arcing when the current therethrough has been depressed to a minimal level to commutate inductor discharging current into the rails of a longitudinally aligned launch rail gun section of the launcher to accelerate the mass therethrough to a high exit velocity.

6 Claims, 2 Drawing Sheets

ELECTROMAGNETIC LAUNCHER WITH IMPROVED CURRENT COMMUTATING SWITCH PERFORMANCE

Figure 1:
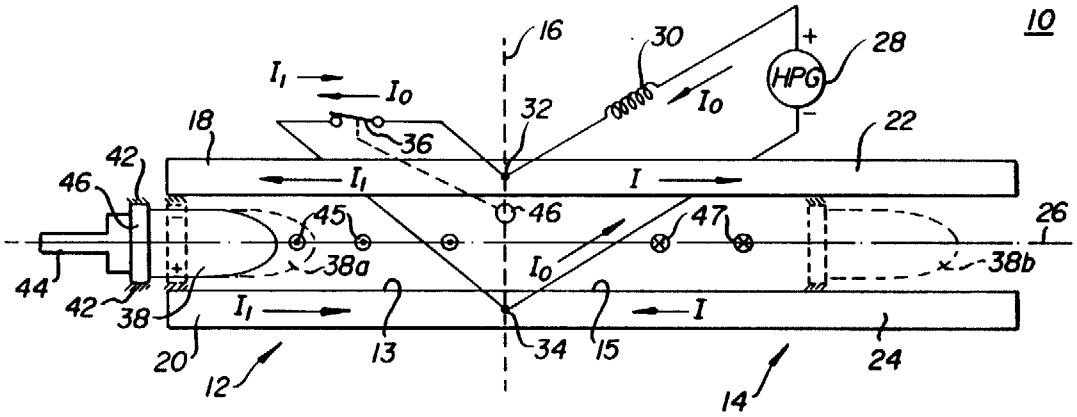

The present invention relates to electromagnetic launchers or railguns for accelerating a mass to a high exit velocity.

BACKGROUND OF THE INVENTION

In electromagnetic launchers of the inductive storage type, a source of high DC current, such as a homopolar generator, drives current through a circuit loop including a storage inductor and a closed current commutating switch. Once the inductor is fully charged, a mass, such as a projectile, equipped with a conductive armature is injected into the breech of the launcher with the armature in sliding electrical contact with a pair of parallel, spaced launcher rails. The switch is then opened to commutate inductor discharging current into the launcher rails with current flow between the rails being conducted by the armature. The armature current reacts with the magnetic field created by the rail current to develop electromotive forces acting on the armature to accelerate the projectile through the launcher to a high exit velocity.

To achieve a desired exit or muzzle velocity wall beyond the capability of chemical gun technology, extremely high DC current magnitudes, in the megampere range are required. Thus, a tremendous burden is imposed on the switch when it is called upon to open the inductor charging circuit loop and commutate DC current of such extraordinary magnitudes into the launcher rails at the moment of launch. Switch opening is accompanied by extremely violent arcing which must be rapidly cleared to avoid degraded launcher performance and possible switch destruction. Thus, each launch extracts a heavy toll on the commutating switch, and its service life is therefore very limited.

It is accordingly an object of the present invention to provide an electromagnetic launcher of the inductive storage type having improved commutating switch performance.

An additional object is to provide an electromagnetic launcher of the above-character, wherein the duty imposed on the commutating switch is minimized.

Another object is to provide an electromagnetic launcher of the above-character, wherein commutating switch service life is dramatically improved.

Yet another object is to provide an electromagnetic launcher of the above-character wherein commutating switch operation is automatically coordinated with the movement through the launcher of a mass being launched.

An additional object is to provide an electromagnetic launcher of the above-character, wherein erosion of the launcher rails is minimized.

A further object is to provide an electromagnetic launcher of the above-character, which is capable of rapid-fire operation.

A still further object is to provide an electromagnetic launcher of the above-character which is more efficient in operation over a long service life.

Other objects of the invention will in part be obvious and in part appear hereinafter.

SUMMARY OF THE INVENTION

In accordance with the present invention, there is provided an electromagnetic launcher comprising a breech section having a pair of rails and a launch section having a pair of rails arranged in longitudinally aligned, end-to-end relation and joined together at a launcher breech. A source of high DC current drives charging current through a storage inductor and a closed commutating switch which is also connected across both the breech section rails and the launching section rails at the launcher breech. A mass equipped with an armature adapted to make moving electrical contact with the breech and launching section rails is propelled by an injector through the breech section toward the launcher breech. The armature, while moving through the breech section, reacts with a magnetic field established therein to generate a breech rail current which flows through the commutating switch in opposition to the inductor charging current. An actuator operates to open the switch upon arrival of the mass at the launcher breech when the current through the switch is depressed substantially to zero. Virtually no arc is drawn at the switch contacts as inductor discharge current is commutated to the launch section rails pursuant to accelerating the mass therethrough to a high exit velocity.

The invention accordingly comprises the features of constructions, combinations of elements and arrangements of parts, all of which will be exemplified in the following Detailed Description, and the scope of the invention will be indicated in the claims.

Figure 2:
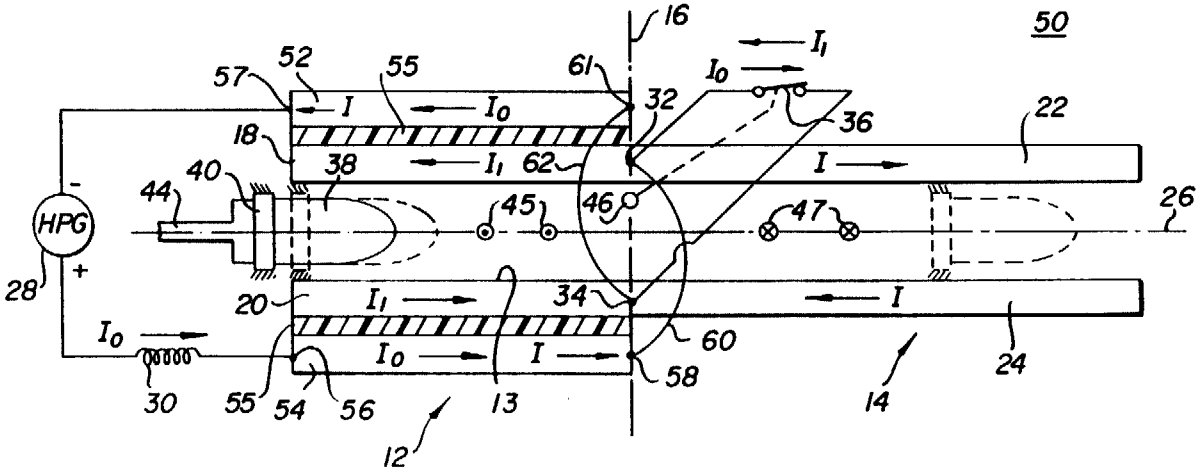
Figure 3:
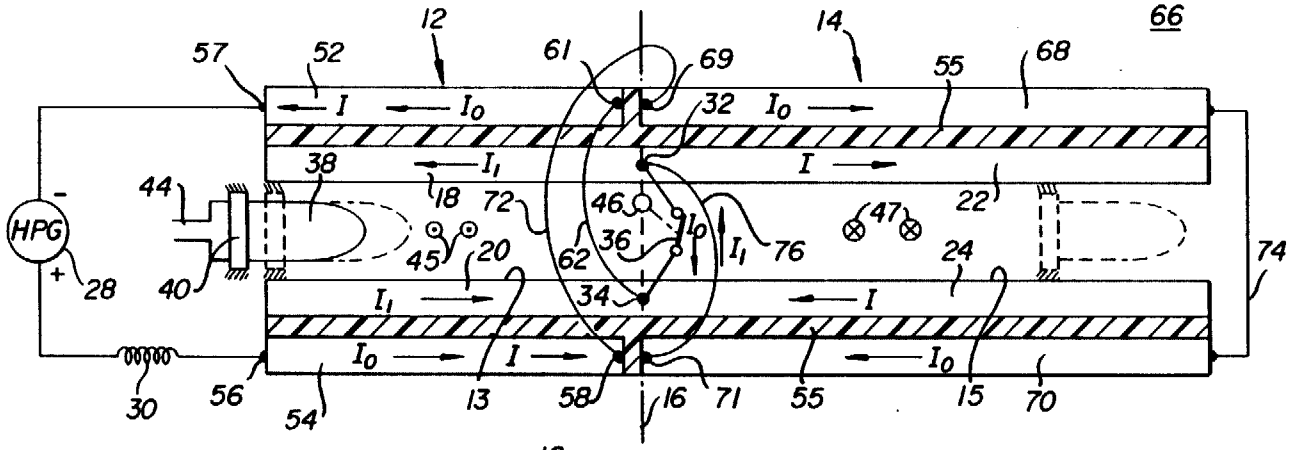
Figure 4:
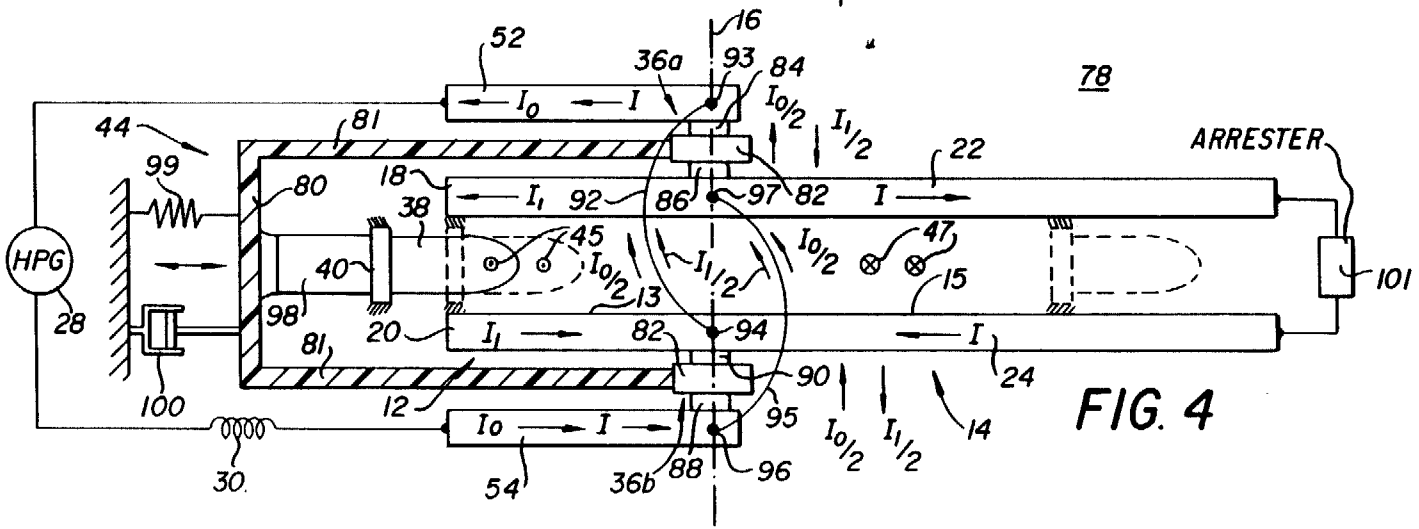

For a full understanding of the nature and objects of the invention, reference may be had to the following detailed description taken in conjunction with the accompanying drawings, in which:

FIG. 1 is a schematic diagram of an electromagnetic launcher embodying the operating principles of the present invention; and FIGS. 2 through 4 are schematic diagrams of alternative embodiments of the invention;

Corresponding reference numerals refer to like parts in the various views of the drawings.

DETAIL DESCRIPTION

The basic principles of the present invention for achieving improved commutating switch performance are illustrated in an electromagnetic launcher generally indicated at 10 in FIG. 1. This launcher is seen to include a breech section, generally indicated at 12 and having a bore 13, and a launch section, generally indicated at 14 and having a bore 15, which are arranged in longitudinally aligned, end-to-end relation and merged or joined together at a launcher breech indicated by phantom line 16. The breech section includes a pair of longitudinally elongated, parallel spaced, electrically conductive rails 18 and 20, while launch section includes a pair of longitudinally elongated, parallel spaced, electrically conductive rails 22 and 24. These rails are symmetrically arranged on opposite sides of the launcher axis 26. Preferably, breech section rail 18 and launch section rail 22 are constituted by a single rail extending the full length of launcher 10. Rails 20 and 24 are likewise constituted.

A source 28 of high DC current such as a homopolar (HPG) and a storage inductor 30 are connected in a circuit loop across terminals 32 and 34 respectively located at the junctions of rails 18, 22 and 20, 24 transversely aligned with the launcher breech 16. Preparatory to a launch, this circuit loop is completed by a closed commutating switch 36 connected across terminals 32, 34.

A mass, such as a projectile 38, to be launched is equipped with an armature 40 carrying suitable means illustrated as opposed brushes 42 positioned to make sliding electrical contact initially with breech rails 18, 20 and ultimately with launch rails 22, 24. Preparatory to launch, the projectile is positioned by an injector 44 just beyond the left end of breech section 12 with the armature brushes in non-contracting relation with the breech rails.

In accordance with a signal feature of the present invention, means is provided to establish a magnetic field in the breech section bore 13 whose flux lines are assumed to be directed out of the drawing sheet, as indicated by the dots 45. Such means may be a permanent or electromagnet, not shown.

To initiate a launch of projectile 38, source 28 begins charging storage inductor 30 with a charging current $I_o$ which is seen to flow from right to left through commutating switch 36. When the inductor is substantially fully charged, injector 44, which may be powered by a chemical gun, light gas gun or pneumatic piston, propels the projectile through the breech section bore 13 at a high velocity. As indicated by the projectile phantom line position **38*a*, the brushes 42 move into sliding electrical contact with the breech section rails, and, as armature 40 moves through this magnetic field in the breech section bore, a voltage of the polarity shown is developed across its ends. This voltage produces a current $I_l$ which flows in the breech section rails and through commutating switch 36 from left to right, i.e., in opposition to current $I_o$. Current $I_l$ produces its own magnetic field which enhances the initial magnetic field in the breech section bore. This positive feedback mechanism causes current $I_l$ to increase as the projectile armature approaches launcher breech 16. By proper selection of the inductance of switch 36, the initial magnetic field strength, the projectile mass, and the breech section rail length, current $I_l$ can be made to achieve a magnitude substantially equal to current $I_o$ at the instant of arrival of the projectile armature at the launcher breech 16 which coincides with the positions of terminals 32, 34. Current through the commutating switch is forced to zero, and thus the switch can be opened without drawing an arc. Suitable detecting means 46 senses the arrival of the projectile armature at the launcher breech and signals switch 36 to open. Inductor discharge current I is thus commutated into rails 22 and 24 of launch section 14, and the projectile, illustrated in phantom at 38*b*, is accelerated through the launch section bore 15** to a high exit or muzzle velocity in conventional railgun fashion.

It will be appreciated that even if complete switch current cancellation is not achieved at the instant the projectile armature arrives at the launcher breech, the switch current will nevertheless be substantially depressed, and thus the burden imposed on the commutating switch to clear the switch current upon opening is minimized.

It will be noted that the current I flowing in the launch section rails is in relatively opposite directions to current $I_l$ flow in the breech section rails, as are the directions of the rail current-produced magnetic fields in the respective section bores, as indicated at 47 in launching section bore 15. Thus, breech section 12 in effect functions as a reverse railgun utilizing the energy of injector 44 to generate breech rail current $I_l$, while launch section functions as a conventional railgun utilizing the energy of launching rail current I to generate projectile-accelerating electromotive forces. It will be appreciated that, since the projectile moves through the bores 13, 15 at a high velocity, the inevitable arcing at the armature brushes produces minimal rail erosion. In addition, cooling requirements are minimized.

Turning to the embodiment of the invention generally indicated at 50 in FIG. 2, breech section 12 is additionally equipped with a pair of augmenting rails 52 and 54 respectively disposed in coextensive, closely spaced parallel relation with breech rails 18 and 20 with with layers 55 of insulation positioned therebetween. One side of the homopolar generator 28 and storage inductor 30 series circuit is connected to terminal 56 at the left or injector end of augmenting rail 54, while the other side of this circuit is connected to the injector end of augmenting rail 52 at terminal 57. A terminal 58 at the breech end of augmenting rail 54 is connected by a shunt 60 to commutating switch terminal 32, and a terminal 61 at the breech end of augmenting rail 52 is connected to commutating switch terminal 34 by a shunt 62. As in FIG. 1, commutating switch 36 is connected across terminals 32 and 34 at the breech 16 of launcher 50.

It is thus seen in FIG. 2 that inductor charging current $I_o$ flows from generator 28 through inductor 30, augmenting rail 54, shunt 60, rightward through switch 36, shunt 62 and augmenting rail 52 back to the generator. The directions of this charging current through the augmenting rails are seen to be such as to advantageously establish the requisite magnetic field in breech section bore 13, as indicated by dots 45. Thus, as with launcher 10 of FIG. 1, propulsion of projectile 38 through breech section bore 13 by injector 44 develops a voltage across the ends of armature 40 of a polarity to drive a current $I_l$ through the breech section rails 18, 20 and through switch 36 in a direction opposed to charging current $I_o$. As in the case of launcher 10, detector 46 triggers the opening of switch 36 upon arrival of the projectile armature 40 at launcher breech 16 when virtual switch current cancellation occurs. Inductor discharge current I is then commutated into rails 22 and 24 of launch section 14 via augmenting rails 52, 54 and crossover shunts 50, 62 to accelerate the projectile to a high exit velocity.

The launcher embodiment of the invention generally indicated at 66 in FIG. 3 is similar to launcher 50 of FIG. 3, except for the addition of augmenting rails 68 and 70 to launch section 14. Thus augmenting rail 68 is disposed in parallel, substantially coextensive relation with rail 22, and augmenting rail 70 is disposed in likewise relation with rail 24. Separation of these additional augmenting rails with the launch section rails and the longitudinally aligned breech section augmenting rails 52, 54 is maintained by intervening insulation 55.

To accommodate the routing of current through these additional augmenting rails, terminal 58 at the breech end of augmenting rail 54 is connected to a terminal 69 at the breech end of augmenting rail 68 by a shunt 72. The muzzle ends of augmenting rails 68 and 70 are shorted together by a shunt 74, while a terminal 71 at the breech end of augmenting rail 70 is connected to commutating switch terminal 32 by a shunt 76. As in launcher 50, shunt 62 connects switch terminal 34 with terminal 61 at the breech end of augmenting rail 52.

Again commutating switch 36 is connected across terminals 32, 34 at launcher breech 16.

It is seen in FIG. 3 that inductor charging current $I_o$ flows from generator 38 through inductor 30, augmenting rail 54, shunt 72, augmenting rail 68, shunt 74, augmenting rail 70, shunt 76, downwardly through switch 36, shunt 62 and augmenting rail 52 back to the generator. The charging current through breech section augmenting rails 52, 54 is again in the directions to produce the requisite magnetic field 45 in bore 13. Thus when projectile 38 is propelled through the breech section bore by injector 44, breech rail current $I_l$ is generated in breech rails 18, 20 to flow upwardly thorugh the commutating switch in opposition to charging current $I_o$. Upon arrival of the projectile armature 40 at launcher breech 16 when the switch current is virtually zero, detector 46 triggers switch 36 to open, and inductor discharge current I is commutated into the launching section rails 22, 24. This current is seen to flow from inductor 30 through augmenting rail 54, shunt 72, augmenting rail 68, shunt 74, augmenting rail 70, shunt 76, rail 22, projectile armature 40, rail 24, shunt 62 and augmenting rail 52 back to generator 28 and the inductor. Since this discharge current flow is in the same corresponding directions in launching section main 22, 24 and augmenting rails 68, 70, the magnetic field 47 in launching launching section bore 15 is enhanced or augmented. Thus, a desired high projectile muzzle velocity can be achieved with reduced discharge current magnitudes.

In the launcher embodiment generally indicated at 78 in FIG. 4, a practical approach to structuring and synchronizing the operation of the commutating switch is disclosed. In this embodiment, the recoil of injector 44 is utilized to effect the opening of the commutating switch substantially at the moment projectile armature 40 arrives at launcher breech 16. To this end, projectile injector 44 includes a recoil mechanism comprising a transverse base 80 for supporting a pair of elongated, electrically insulative arms 81, one extending longitudinally between breech section main rail 18 and augmenting rail 52, and the other between breech section main rail 20 and augmenting rail 54. A conductive brush 82 is affixed to the free end of each arm 81 in illustrated pre-launch positions transversely aligned with launcher breech 16. One of these brushes is seen to electrically bridge the gap between a contact 84 carried adjacent the breech end of augmenting rail 52 and a contact 86 carried at the junction of breech section main rail 18 and launch section rail 22 aligned with launcher breech 16. This brush thus, in effect, constitutes the movable contact of a commutating switch section generally indicated at 36*a*. The other brush 82 is seen to electrically bridge the gap between a contact 88 carried adjacent the breech end of augmenting rail 54 and a contact 90 carried at the junction of breech section main rail 20 and launch section rail 24 aligned with the launcher breech. This provides a second commutating switch section generally indicated at 36*b*. Rail crossover current flow is accommodated by a shunt 92 connected between a terminal 93 at the breech end of augmenting rail 52 and a terminal 94 at the junction of rails 20 and 24. A second shunt 95 is connected from a terminal 96 at the breech end of augmenting rail 54 and terminal 97 at the junction of rails 18 and 22. These terminals are preferably positioned in transvese alignment with the launch breech as illustrated.

Base 80 of injector 44 is equipped to mount a conventional shell 98 containing an explosive charge and to which projectile 38 is mated in forwardly firing relation. The base is backed by a spring 99 and a dashpot 100 designed to regulate the recoil motion of the base 80-arms 81 recoil structure upon detonation of shell 98 to propel the projectile through breech section bore 13.

Preparatory to launch, generator 28 charges storage inductor 30 with charging current $I_o$ which flows through augmenting rail 54. At the breech end thereof, this charging current divides, with substantially one-half ($I_o/2$) flowing upwardly through switch section 36*b* and shunt 92 to augmenting rail 52 in returning to the generator. The other half ($I_o/2$) flows through shunt 95, upwardly through switch section 36*a* and through augmenting rail 52 back to the generator. Charging current flow through the augmenting rails establishes the requisite magnetic field 45 in breech section bore 13 as in the embodiments described above. When storage inductor 30 is substantially fully charged, shell 98 is fired to propel projectile 38 through bore 13. Breech rail current $I_l$ is then generated to flow from armature 40 through rail 20 toward its breech end. Substantially one-half ($I_l/2$) of this current flows downwardly through switch section 36*b*, upwardly through shunt 95, rail 18 and back to the armature. The other half flows through shunt 92 and downwardly through switch section 36*a* to rail 18 and the armature. It is seen that breech rail current $I_l$ flows in opposition to charging current $I_o$ in each of the commutating switch sections 36*a*, 36*b*, and thus the switch current is being progressively depressed. At the same time, the recoil mechanism (base 80 and arms 81) is recoiling to the left, drawing brushes 82 out from the switch gaps between contacts 84, 86 and contacts 88, 90. This recoiling motion is controlled by spring 99 and damping dashpot 100 such that brushes 82 are removed from the contact gaps to open switch sections 36*a*, 36*b* at the moment projectile armature 40 arrives at launch breech 16. This removal coincides with substantial cancellation of the switch currents. Thus the simultaneous openings of the commutating switch sections is accompanied by little or no arcing. Gases from the exploding shell 98 may be directed into the switch gaps to assist in extinguishing any arcing that does exist. Moreover, the geometries of the switch contacts and brushes and the characteristics of the recoil motion can be tailored such that the rate of switch current depression reasonably matches the rate of contact area reduction to maintain substantially constant current densities in the commutating switches leading up to the moment of opening. Switch life is therefore extended.

As the projectile moves into bore 15, inductor discharging current is commutated into the launch section rails from inductor 30 through augmenting rail 54, shunt 95, rail 22, projectile armature 40, rail 24, shunt 92, and augmenting rail 52 back to generator 28 and the inductor. The projectile is thus accelerated through the launching section bore to a high muzzle velocity. If desired, an arrester 101 may be connected across the muzzle end of rails 22, 24 to suppress the muzzle flash attending projectile exit from bore 15. Just before the projectile has cleared launcher 78, spring 99 restores the injector recoil mechanism to its solid line pre-launch position in FIG. 4 with brushes 82 again bridging the switch section contact gaps. This action diverts from the launch section rails the current associated with energy remaining in inductor 30 through the reclosed switch sections 36a, 36b to begin recharging the inductor. Also, magnetic energy remaining in the launching section rails can then be discharged through arrester 101. A new shell 98 and projectile 38 can then be loaded on the injector recoil mechanism, and, when the inductor charging current reaches a predetermined magnitude, launcher 78 is ready to launch again in rapid-fire fashion.

It is seen from the foregoing that the objects set forth above, including those made apparent from the preceding description, are efficiently attained, and, since certain changes may be made in the disclosed embodiments without departing from the scope of the invention, it is intended that all matters of details disclosed herein be taken as illustrative and not in a limiting sense.

Having described the invention, what I claim as new and desire to secure by Letters Patent is:

1. An electromagnetic launcher for launching a mass equipped with a conductive armature, said launcher comprising, in combination:

A. a breech section including a pair of first rails extending along a first bore;

B. a launch section including a pair of second rails extending along a second bore longitudinally aligned with said first bore and communicating therewith at a launcher breech;

C. a commutating switch connected with said first and second rails;

D. a high DC current source and a storage inductor connected in series circuit across said switch;

E. means for establishing a magnetic field in said first bore including a pair of augmenting rails arranged in closely spaced, substantially coextensive relation with said first rails, said augmenting rails being connected in said source and inductor series circuit to conduct charging current for said inductor;

F. injector means including an explosive shell which is detonated to propel the mass through said first bore toward said breech with the armature completing a current path between said first rails;

G. actuating means including a recoil mechanism actuated by the detonation of said shell for opening said switch; and H. whereby, with said switch closed, said source drives said charging current through said inductor and said switch, and, upon propulsion of the mass through said first bore by said injector means, the armature reacts with said magnetic field to generate a breech rail current in said first rails which flows through said switch in opposition to said charging current, said actuating means opening said switch to commutate inductor discharging current into said second rails when the current through said switch is depressed to a minimal level, said discharging current flowing through the armature to electromotively accelerate the mass through said second bore to a high exit velocity.

2. An electromagnetic projectile launcher comprising, in combination:

A. a breech section including first and second longitudinally elongated, conductive rails arranged in parallel spaced relation;

B. a launch section joined with said breech section as a longitudinal extension thereof at a launcher breech and including first and second longitudinally elongated, conductive rails arranged in parallel spaced relation and respectively joined end-to-end with said first and second rails of said breech section at first and second junctions aligned with said launcher breech, said first and second junctions having first and second electrical terminals thereat;

C. a high DC current source and storage conductive electrically connected in a series circuit across said first and second terminals;

D. a current commutating switch electrically connected across said first and second terminals;

E. means for establishing a magnetic field in the space between said first and second rails of said breech section including first and second augmenting rails respectively arranged in closely spaced, substantially coextensive relation with said breech section first and second rails, said first and second augmenting rails included in said source and inductor series circuit to conduct inductor charging current to and from said first and second terminals;

F. means for establishing a magnetic field in the space between said first and second rails of said launch section including a third augmenting rail disposed in closely spaced, substantially coextensive relation with said first rail of said launch section, a fourth augmenting rail disposed in closely spaced, substantially coextensive relation with said second rail of said launch section;

G. electrical interconnecting means including a first shunt connecting the end of said first augmenting rail adjacent said launcher breech to said second terminal, a second shunt interconnecting the ends of said second and third augmenting rails adjacent said launcher breech, a third shunt connecting the end of said fourth augmenting rail adjacent said launcher breech to said first terminal, and a fourth shunt interconnecting the ends of said third and fourth augmenting rails remote from said launcher breech;

H. a projectile equipped with a conductive armature for conducting current between said first and second rails of said breech and launch sections;

I. injector means for propelling said projectile through said breech section towards said launcher breech; and J. actuating means for opening said switch;

K. whereby, with said switch closed, said source drives said charging current through said inductor and said switch and, upon propulsion of said projectile through said breech section by said injector means, said armature reacts with said magnetic field to generate a breech rail current in said first and second rails of said breech section which flows through said switch in opposition to said charging current, said actuating means opening said switch to commutate inductor discharging current into said first and second rails of said launch section when the current through said switch is depressed to a low level, said discharging current flowing through said armature to electromotively accelerate said projectile through said launch section to a high exit velocity.

3. An electromagnetic projectile launcher comprising, in combination:

A. a breech section including first and second longitudinally elongated, conductive rails arranged in parallel spaced relation;

B. a launch section joined with said breech section as a longitudinal extension thereof at a launcher breech and including first and second longitudinally elongated, conductive rails arranged in parallel spaced relation and respectively joined end-to-end with said first and second rails of said breech-section at first and second junctions aligned with said launcher breech, said first and second junctions having respective first and second electrical terminals thereat;

C. a high DC current source and storage conductor electrically connected in a series circuit across said first and second terminals;

D. a current commutating switch electrically connected across said first and second terminals;

E. means for establishing a magnetic field in the space between said first and second rails of said breech section including first and second augmenting rails respectively arranged in closely spaced, substantially coextensive relation with said first and second rails of said breech section, said augmenting rails included in said source and inductor series circuit to conduct inductor charging current to and from said first and second terminals;

F. electrical interconnecting means including a first shunt connecting an end of said first augmenting rail adjacent said launcher breech to said second terminal and a second shunt connecting an end of said second augmenting rail adjacent said launcher breech to said first junction;

G. a projectile equipped with a conductive armature for conducting current between said first and second rails of said breech and launch sections;

H. injector means including an explosive shell which is detonated to propel said projectile through said breech section towards said launcher breech; and I. actuating means including a recoil mechanism actuated by the detonation of said shell for opening said switch;

J. whereby, with said switch closed, said source drives said charging current through said inductor and said switch and, upon propulsion of said projectile through said breech section by said injector means, said armature reacts with said magnetic field to generate a breech rail current in said first and second rails of said breech section which flows through said switch in opposition to said charging current, said actuating means opening said switch to commutate inductor discharging current into said first and second rails of said launch section when the current through said switch is depressed to a low level, the flows of said breech rail current in said first and second rails of said breech section are in respective opposite directions to the flows of said discharging current in said first and second rails of said launch sections, said discharging current flowing through said armature to electromotively accelerate said projectile through said launch section to a high exit velocity.

4. The electromagnetic launcher defined in claim 3, wherein said commutating switch includes a first switch section for conducting said charging and breech rail currents between said first end of said first augmenting rail and said first junction, and a second switch section for conducting said charging and breech rail currents between said first end of said second augmenting rail and said second junction, said actuating means operating to simultaneously open said first and second switch sections.

5. The electromagnetic launcher defined in claim 4, wherein said first switch section includes first and second contacts respectively mounted at said first end of said first augmenting rail and at said first junction in spaced relation to provide a first switch gap, and said second switch section includes first and second contacts respectively mounted at said first end of said second augmenting rail and said second junction to provide a second switch gap, said recoil mechanism carrying a separte conductive brush for pre-launch disposition in each of said first and second switch gaps to conduct said charging and breech rail currents between said first and second contacts of each of said first and second switch sections, the recoiling motion of said recoil mechanism in response to detonation of said shell concurrently withdrawing said brushes from said first and second switch gaps to open said first and second switch sections, said recoil mechanism further including regulating means for controlling the withdrawal rate of said brushes.

6. The electromagnetic launcher defined in claim 5, wherein said regulating means restores said brushes to said pre-launch dispositions in said first and second switch gaps just before the exiting of said projectile from said launch section in preparation for launching another one of said projectiles in rapid-fire fashion.

* * * * *